United States Patent [19]

Stout

[11] Patent Number: 5,031,760

[45] Date of Patent: Jul. 16, 1991

[54] CARRIER FOR ARTICLES OF DIFFERENT SIZES

[75] Inventor: James T. Stout, Acworth, Ga.

[73] Assignee: The Mead Corporation, Dayton, Ohio

[21] Appl. No.: 604,579

[22] Filed: Oct. 26, 1990

[51] Int. Cl.[5] ..... B65D 75/00

[52] U.S. Cl. ..... 206/180; 206/223; 206/188; 206/427

[58] Field of Search ..... 206/223, 180–191, 206/175, 427

[56] References Cited

U.S. PATENT DOCUMENTS

| | | | |
|---|---|---|---|
| 3,814,237 | 6/1974 | Forrer | 206/167 |
| 4,010,847 | 3/1977 | Wood et al. | 206/190 X |
| 4,258,844 | 3/1981 | Stout | 206/188 |
| 4,308,950 | 1/1982 | Wood | 206/188 |
| 4,402,400 | 9/1983 | Stout | 206/188 |
| 4,601,390 | 7/1986 | Rosenthal et al. | 206/175 |
| 4,792,038 | 12/1988 | Cooper | 206/188 |
| 4,798,285 | 1/1989 | Hernandez | 206/188 |
| 4,930,629 | 6/1990 | Petty | 206/191 X |

*Primary Examiner*—William I. Price

*Attorney, Agent, or Firm*—Rodgers & Rodgers

[57] ABSTRACT

A basket style article carrier having bottom, side and end walls together with telescoping medial and handle panels forming a medial longitudinal strut is provided with transverse partition panels interconnected between the medial longitudinal strut and the side walls, the transverse partition panels being spaced so as to form end cells of the same size and form a center cell of a different size on one side of the medial strut and which on the opposite side of the medial strut transverse partition spacer straps are interconnected between the medial panels and the adjacent side wall so as to provide an article receiving cell which is of substantially the same configuration and size as the end cells at each corner of the carrier.

10 Claims, 7 Drawing Sheets

CARRIER FOR ARTICLES OF DIFFERENT SIZES

TECHNICAL FIELD

This invention relates to basket style article carriers which are specially adapted for transporting articles of different sizes and of different shapes.

BACKGROUND ART

U.S. Pat. No. 4,792,038 issued Dec. 20, 1988 discloses a basket style carrier for articles of various sizes. The structure of this carrier is such that the cells on one side of the carrier handle are of a greater total longitudinal dimension than is the total longitudinal length of the cells on the other side of the carrier handle. This structure produces an unbalanced arrangement which does not lend itself to stacking in tiers one above another and which also is prone to impose undesirable stresses on the carrier components due to its unbalanced characteristic.

SUMMARY OF THE INVENTION

According to this invention in one form, a basket style carrier is provided which includes a bottom wall, side walls foldably joined to the side edges of the bottom wall, end wall panels foldably joined respectively to the end edges of the side walls and extending inwardly therefrom. Medial panels joined to the end wall panels are disposed in telescoping overlapping relation and a transverse partition panel is struck from each medial panel and is foldably joined thereto at the inner ends thereof and at its outer end to the associated side wall. In order to provide for stackability of one tier above another, the corner cells are of the same size and cross sectional configuration so that end articles in one carrier provide balanced support for an article mounted thereon. An intermediate cell on one side of the carrier is of a different size than the end cells so as to accommodate a different item of different size and configuration. On the other side of the carrier, the center cell suitable spacer panels interposed between a pair of transverse partition panels which serve to control the size and configuration of such center cell as to conform with the shape and configuration of the corner cells thereby to render the carrier suitable for transporting and storing five similar articles.

BEST MODE OF CARRYING OUT THE INVENTION

Figure 1:
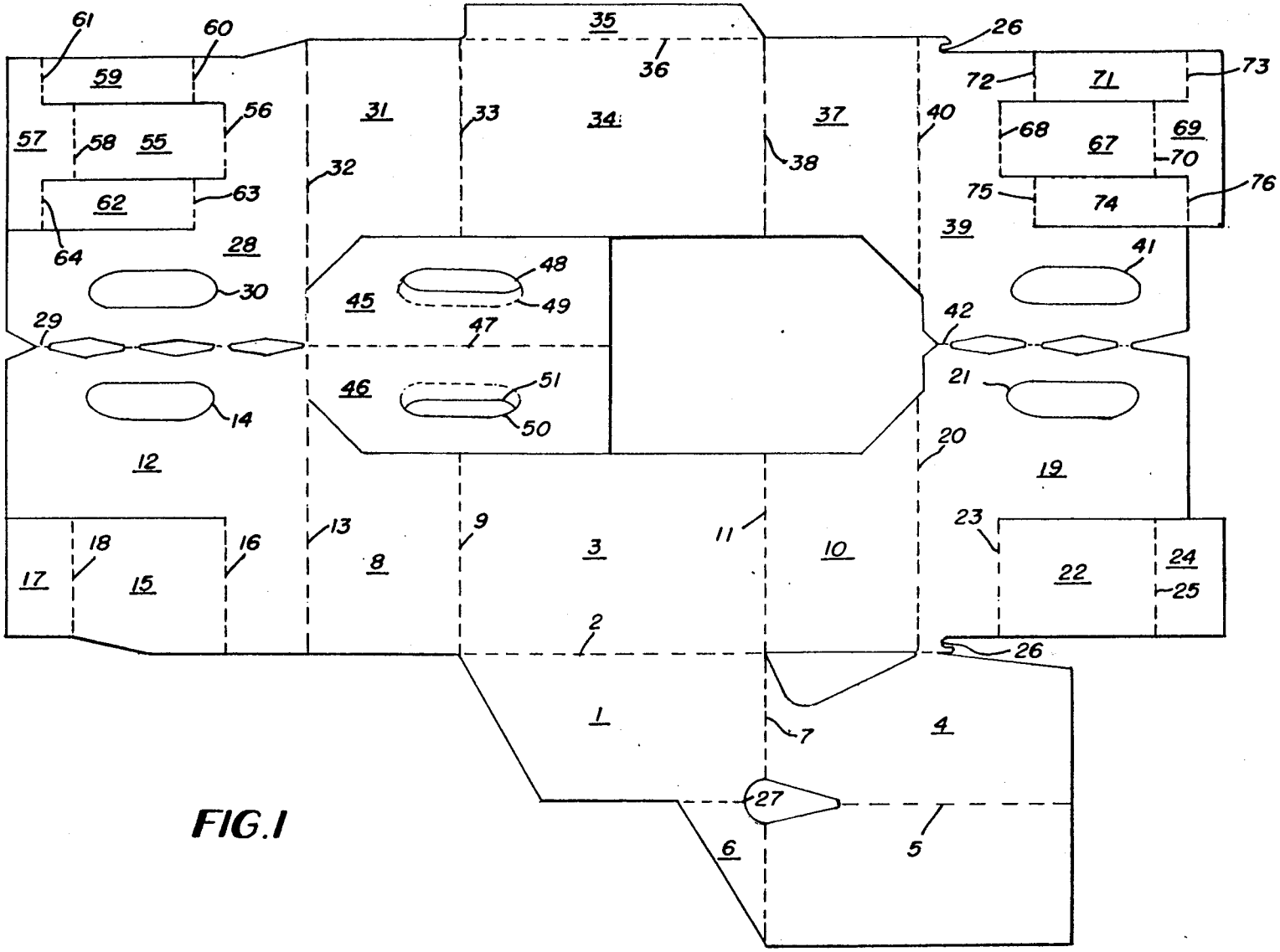
FIG. 1 is a plan view of a blank formed according to this invention as viewed from the inner surface of the blank.

With reference to FIG. 1, the numeral 1 designates a bottom wall panel which is foldably joined along a side edge thereof to the bottom edge 2 of a first side wall 3. A reinforcing bottom panel 4 includes a medial fold line 5 which divides the bottom reinforcing panel 4 into a pair of components and which also separates bottom wall panel 1 from triangular panel 6. Fold line 7 serves to adjoin panel 4 to triangular panel 6 and to bottom wall panel 1. The bottom wall of the carrier is formed according to U.S. Pat. No. 4,258,844 issued Mar. 31, 1981 and owned by the assignee of this invention.

Side wall 3 is foldably joined to end wall panel 8 along fold line 9 and is foldably joined to end wall panel 10 along fold line 11. Medial panel 12 is foldably joined to end wall panel 8 along a fold line 13. A hand hold aperture 14 is formed in medial panel 12. A transverse partition panel 15 is struck from medial panel 12 and foldably joined thereto along fold line 16. Transverse partition panel 15 is foldably joined to anchoring flap 17 along a fold line 18. Medial panel 19 is foldably joined to end wall panel 10 along a fold line 20 and a hand gripping aperture 21 is formed in medial panel 19. A transverse partition panel 22 is struck from medial panel 19 and is foldably joined thereto along a fold line 23. An anchoring flap 24 is foldably joined to transverse partition panel 22 along fold line 25.

On the other side of the carrier, a medial panel 28 is foldably joined along interrupted fold line 29 to medial panel 12. Hand hold aperture 30 is formed in medial panel 28. End wall panel 31 is foldably joined to medial panel 28 along fold line 32 and is also foldably joined along fold line 33 to side wall 34. A glue flap 35 is foldably joined to side wall 34 along fold line 36. End wall panel 37 is foldably joined to side wall 34 along fold line 38 and medial panel 39 is foldably joined to end wall panel 37 along fold line 40. A hand gripping aperture 41 is formed in medial panel 39 which is foldably joined along interrupted fold line 42 to medial panel 19.

For reinforcing the medial longitudinal strut comprising medial panels 12, 19, 28 and 39, a pair of outer handle panels 45 and 46 are foldably joined respectively to medial panels 28 and 12 along fold lines 32 and 13. Outer handle panels 45 and 46 are foldably joined to each other along fold line 47. Hand gripping aperture 48 and an associated cushioning flap 49 are formed in outer handle panel 45 and hand gripping aperture 50 and its associated cushioning flap 51 are formed in outer handle panel 46.

In accordance with one feature of this invention, a transverse partition panel 55 is struck from medial panel 28 and foldably joined thereto along fold line 56. An anchoring flap 57 is foldably joined to transverse partition panel 55 along fold line 58. A transverse partition spacer strap 59 is foldably joined to medial panel 28 along a fold line 60 and to anchoring flap 57 along a fold line 61. Similarly a transverse partition spacer strap 62 is foldably joined to medial panel 28 along a fold line 63 and to anchoring flap 57 along fold line 64. As is obvious anchoring flap 57 is of generally T-shaped configuration.

At the other end of the carrier, a transverse partition panel 67 is foldably joined to medial panel 39 along fold line 68 and to anchoring flap 69 along fold line 70. A transverse partition spacer strap 71 is foldably joined to medial panel 39 along fold line 72 and to anchoring flap 69 along fold line 73. Similarly transverse partition spacer strap 74 is foldably joined to medial panel 39 along fold line 75 and to anchoring flap 69 along fold line 76. Anchoring flap 69 is of generally T-shaped configuration.

The formation of a completed carrier from the blank shown in FIG. 1 is initiated by elevating the transverse partition panel 67 and the transverse partition spacer straps 71 and 74 along with the T-shaped anchoring flap 69 and thereafter by folding these elements toward the left. The generally T-shaped anchoring flap 69 during this folding operation is simply elevated and shifted into the position shown in FIG.2. Transverse partition panel 22 is elevated and folded to the left along fold line 23 and thus appears as shown in FIG. 2.

Figure 2:
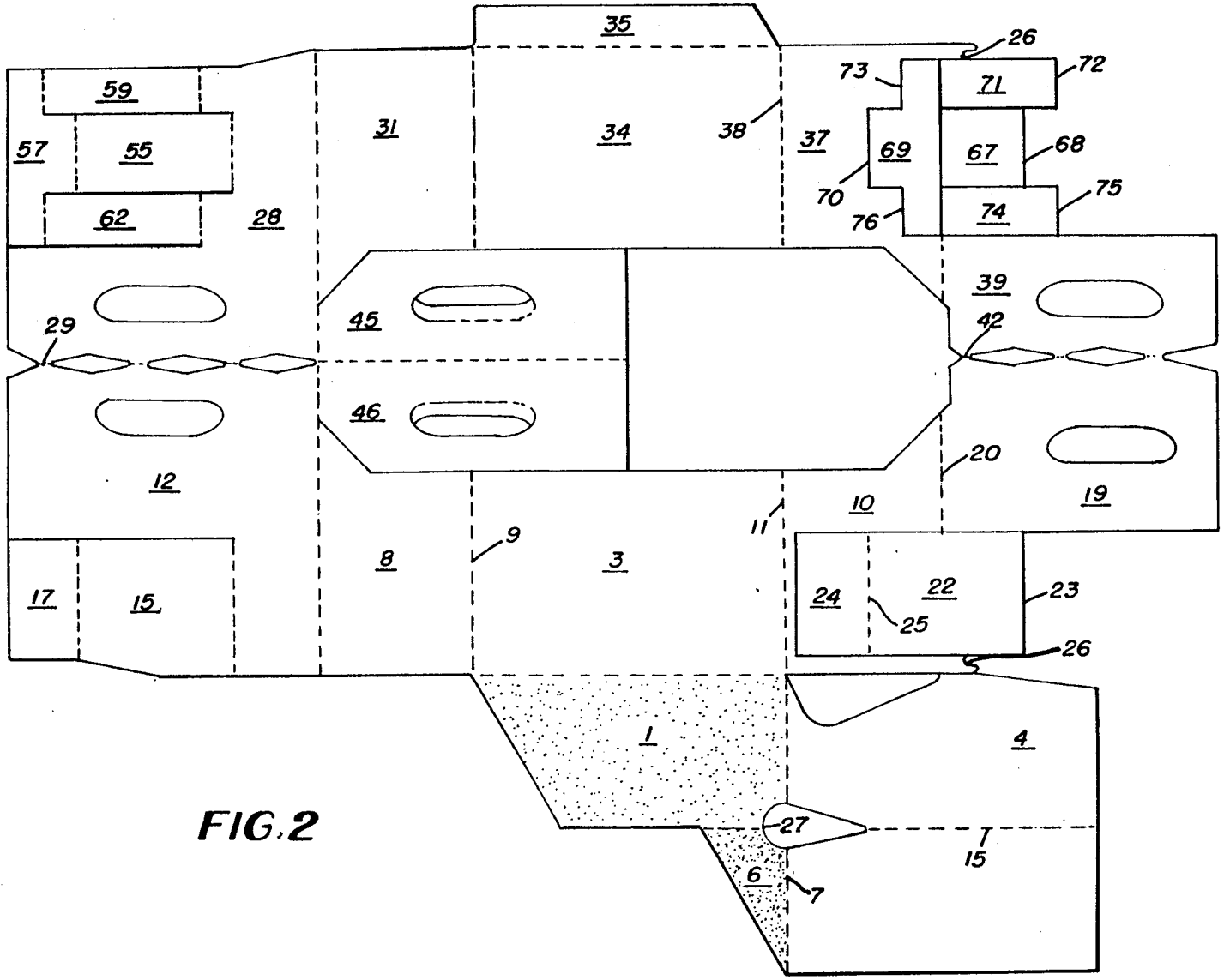
FIGS. 2–6 inclusive represent intermediate folding and gluing operations of the blank of FIG. 1 whereby a collapsed completed carrier as shown in FIG. 7 is formed.
Figure 3:
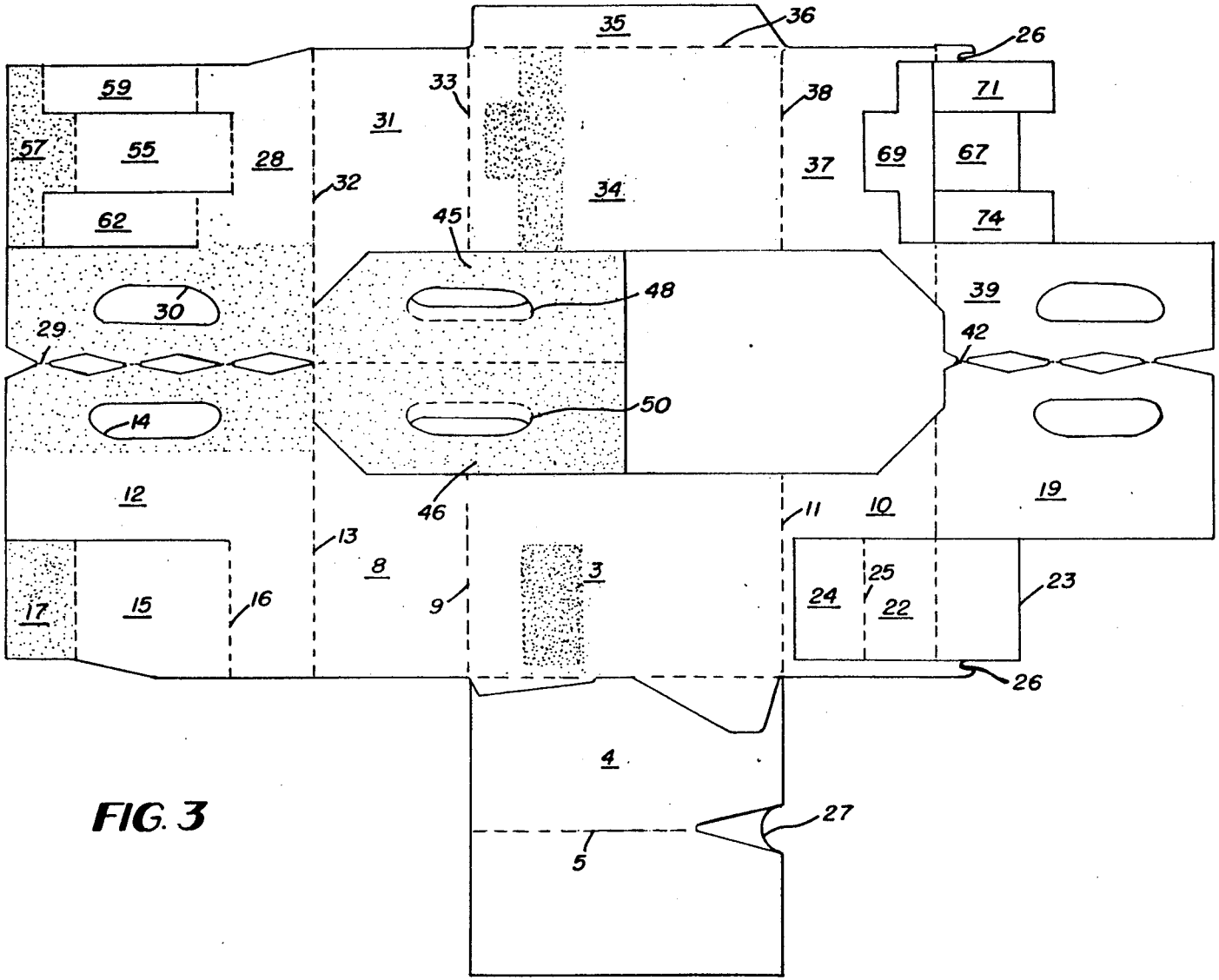

Thereafter an application of glue is made to bottom wall panel 1 and to reinforcing bottom wall 6 as indicated by stippling in FIG. 2 and the bottom wall 4 is elevated and folded to the left along fold line 7 to glue bottom panels 1 and 4 together to occupy the positions shown in FIG. 3.

Figure 4:
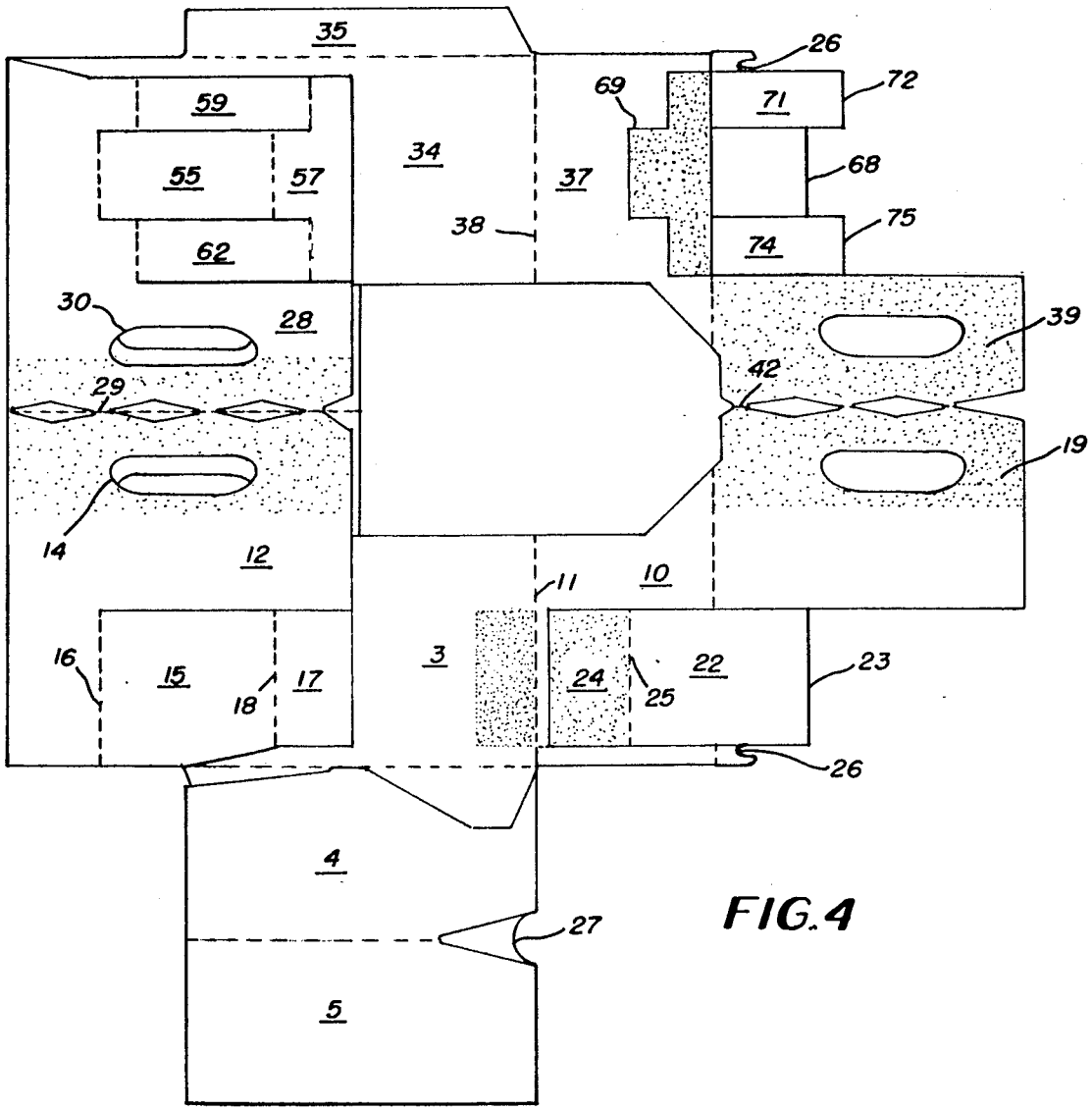

Thereafter an application of glue is made to the blank as indicated by stippling in FIG. 3 following which the medial panels 12 and 28 are elevated and folded to the right along the fold lines 13 and 32. This folding operation causes the anchoring flap 57 to adhere to the inner surface of side wall 34 and causes medial panels 12 and 28 to adhere to the inner surfaces of outer handle panels 45 and 46 respectively. This operation also causes the anchoring flap 17 to adhere to the inner surface of side wall 3 and the blank then appears as shown in FIG. 4. Hand holds 30 and 14 overlie and fall into general coincidence with hand gripping apertures 48 and 50 formed in outer handle panel 45 and 46 respectively.

Figure 5:
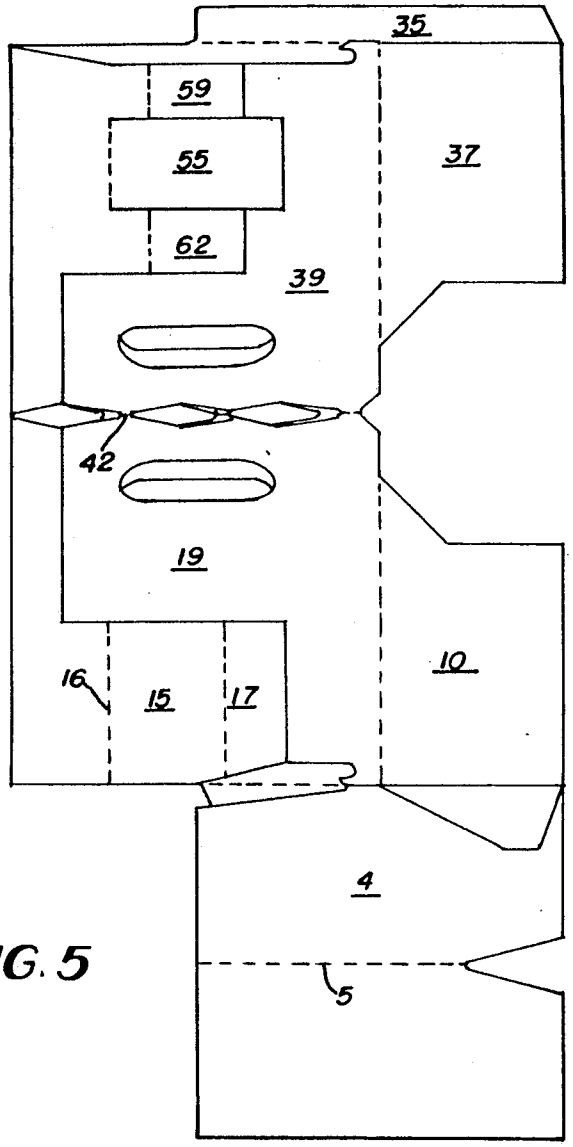

Thereafter an application of glue is applied to anchoring flap 69 and to anchoring flap 24 as well as to medial panels 19 and 39 as indicated by stippling in FIG. 4. End wall panels 10 and 37 are then elevated and folded to the left along fold lines 11 and 38 respectively. This operation causes the medial panel 19 to become adhered to medial panel 12 and causes medial panel 39 to become adhered to medial panel 28. Also anchoring flap 69 becomes adhered to side wall 34 and anchoring flap 24 becomes adhered to side wall 3 and the blank appears as shown in FIG. 5.

Figure 6:
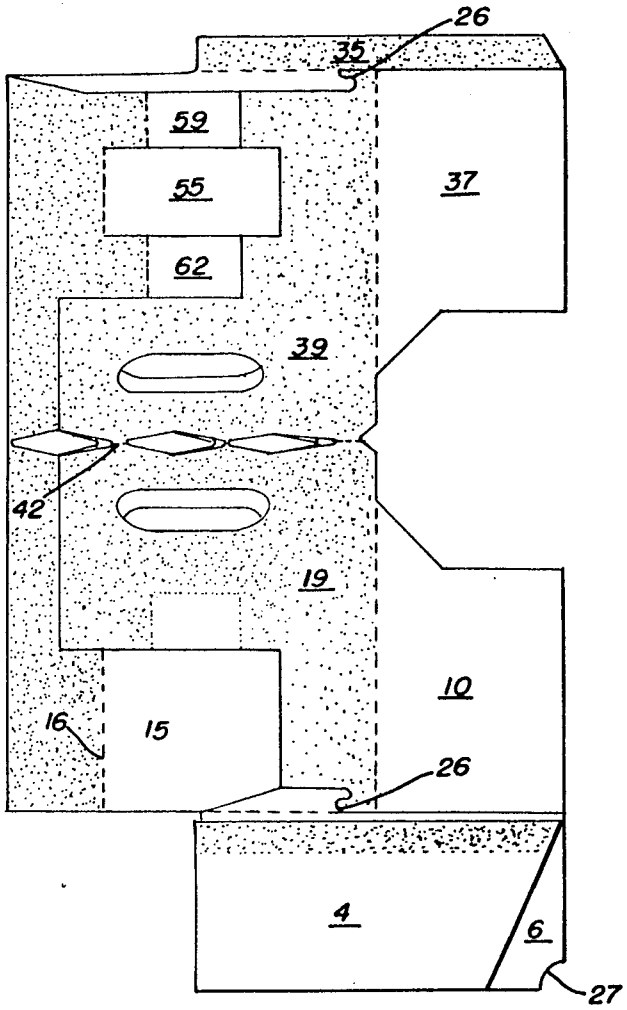
Figure 7:
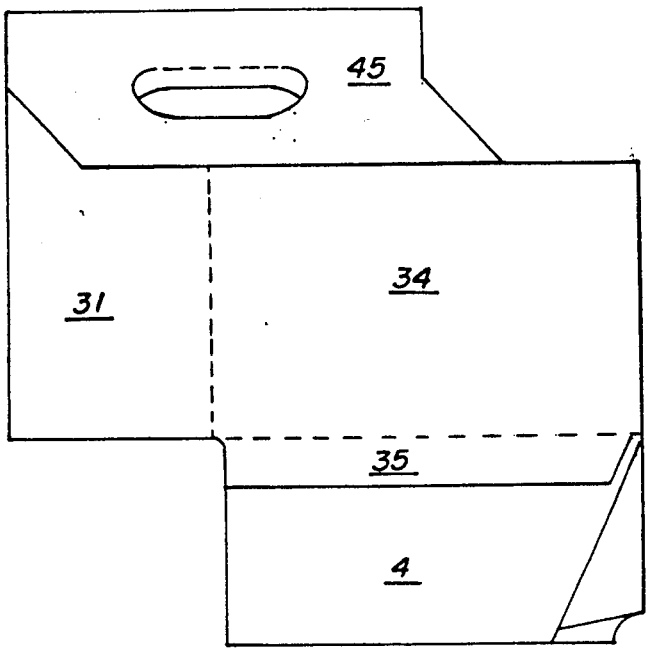
Figure 8:
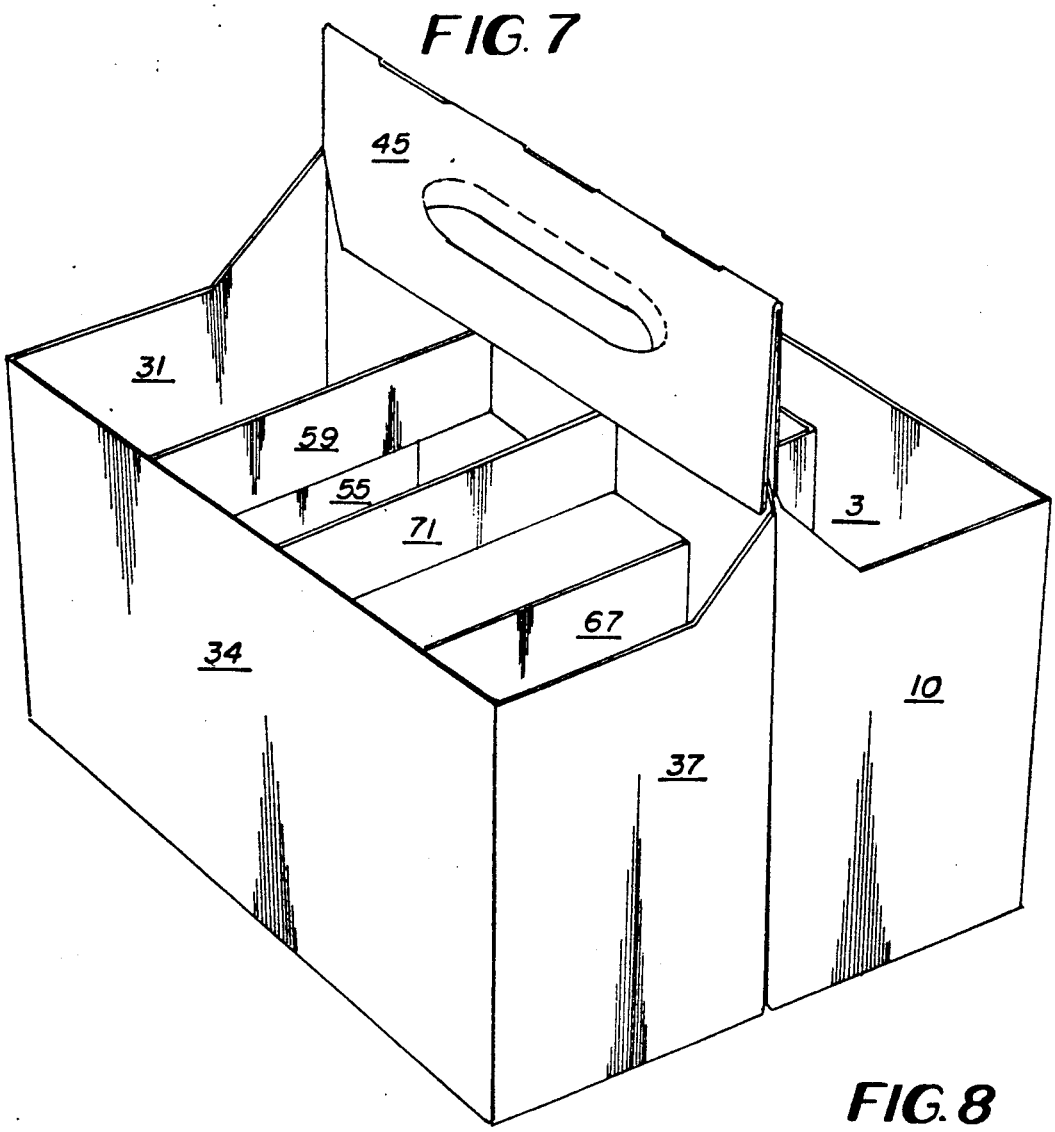
FIG. 8 is simply a perspective view of the carrier of FIG. 7 when set up and ready for loading.

The bottom reinforcing wall 1, 4 is manipulated by folding the bottom reinforcing wall 4 along the fold line 5 so that it then occupies the position shown in FIG. 6. Thereafter an application of glue is made to the medial panels 19, 39 and to the glue flap 35 and to the bottom reinforcing wall 4 as shown in stippling in FIG. 6. Parts of the blank above the interrupted fold line 42 are elevated and folded forwardly into contact with the cooperating parts to cause the glue flap 35 to adhere to the bottom wall 14 and to cause the medial panels 39 and 19 to become adhered to each other and the blank appears in completed collapsed form as shown in FIG. 7 and the set up carrier appears as shown in FIG. 8. The notches 26 engage the arcuate cut 27 to lock the carrier in set up condition in a manner well known in the art.

Figure 9:
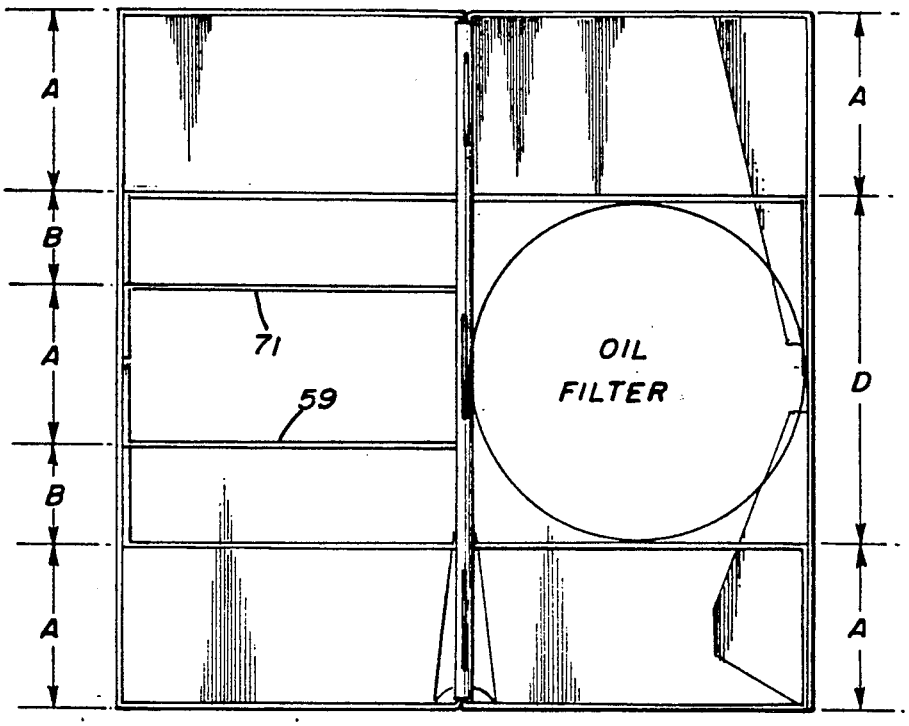
FIG. 9 is a view from above of the carrier as shown in FIG. 8
Figure 10:
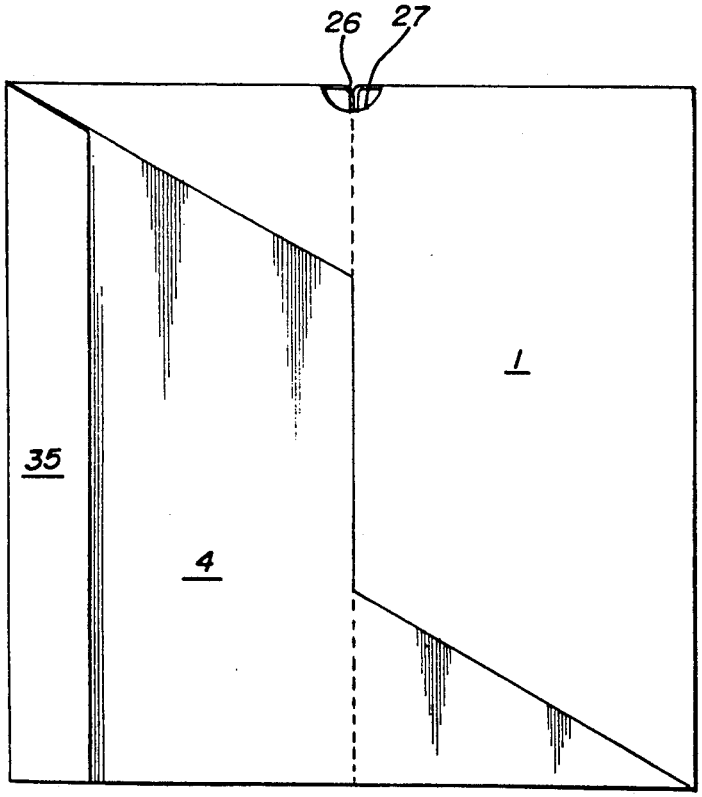
FIG. 10 is a view of the bottom of the carrier shown in FIG. 8.

As shown from above in FIG. 9, the carrier includes 5 cells whose longitudinal dimensions are designated at "A" which are of equal size and configuration. The dimensions designated in FIG. 9 at "B" are defined by spacer panels and the letter "D" designates the spacing between the inner walls of the end cells so that the formula "B" equals "D" minus "A" divided by 2. The fifth space whose longitudinal dimension is represented by "D" can conveniently be used for transporting a different article such as an oil filter. The corner cells including the center cell on the opposite side of the carton medial strut from the oil filter is suited to receive a container of rectangular cross section and which is formed of suitable plastic such as polyvinyl chloride and which could be used to market and transport motor oil. Since the corner containers for oil protrude above the top edge of the carton handle, these upwardly extending containers constitute a sturdy and reliable basis on which another carton can be stacked. Thus the invention provides ready stackability which is stable and which affords an attractive appearance while also providing for the sale and transport of dissimilar items such as oil containers and an oil filter.

I claim:

1. An article carrier comprising a bottom wall, side walls foldably joined respectively to the side edges of said bottom wall, end wall panels foldably joined respectively to the end edges of said side walls and extending inwardly therefrom, a pair of medial panels foldably joined respectively to the inner edges of both of said end wall panels at each end of the carrier and into telescoping relation with each other to form a medial longitudinal strut, a transverse partition panel struck from each of said medial panels and foldably joined thereto along a vertical fold line, an anchoring flap foldably joined to the outer end of each of said transverse partition panels and secured to the inner surface of the adjacent side wall to form an end cell adjacent each of said end wall panels, and a first transverse partition spacer strap struck from each of said medial panels on one side of said medial longitudinal strut and foldably joined thereto and spaced longitudinally inward respectively from the associated transverse partition panel on said one side of said medial longitudinal strut so as to limit the longitudinal dimension of a center cell disposed between said end cells on said one side of said medial longitudinal strut, the outer ends of said first transverse partition spacer straps being foldably joined to the adjacent ones of said anchoring flaps respectively.

2. An article carrier according to claim 1 wherein a second transverse partition spacer strap is struck from each of said medial panels on said one side of said medial longitudinal strut and foldably joined thereto, each of said second transverse partition spacer straps being spaced vertically from the adjacent first transverse partition spacer strap and the outer ends of said second pair of transverse partition straps being foldably joined respectively to the adjacent one of said anchoring flaps.

3. An article carrier according to claim 2 wherein said adjacent ones of said anchoring flaps are of generally T-shaped configuration.

4. An article carrier according to claim 1 wherein the end cells on each side of said medial longitudinal strut are of rectangular cross sectional configuration.

5. An article carrier according to claim 1 wherein a hand gripping aperture is formed in each of said medial panels and wherein said apertures are disposed in substantial coincidence with each other.

6. An article carrier according to claim 1 wherein a pair of outer handle panels are disposed about said longitudinal strut and secured thereto and wherein a hand gripping aperture is formed in each of said outer handle panels.

7. An article carrier according to claim 1 wherein the space between each of said first transverse partition spacer straps and the adjacent one of said transverse partition panels is equal to one-half the difference between the longitudinal dimension between the end cells and the longitudinal dimension of each end cell.

8. An article carrier blank comprising a bottom wall panel, a first side wall foldably joined to a side of said bottom wall panel, a first pair of end wall panels foldably joined respectively to the end edges of said first side wall, a first pair of medial panels foldably joined respectively to the edges of said end wall panels which are remote from said first side wall, a first outer handle panel foldably joined along one end thereof to one of said medial panels, a second outer handle panel foldably joined along a medial edge thereof to a medial edge of said first handle panel, a second pair of medial panels foldably joined along medial edges thereof to medial edges of said first pair of medial panels, one of said second pair of medial panels being foldably joined along an end edge thereof to an end edge of said second outer handle panel, a second pair of end wall panels foldably joined along vertical inner edges thereof to vertical end edges of said second pair of medial panels respectively, a second side wall foldably joined respectively along its end edges with vertical outer edges of said second pair of end wall panels, a glue flap foldably joined to the bottom edge of said second side wall, a transverse partition panel foldably joined along the inner end thereof to each of said first and second medial panels, an anchoring flap foldably joined to the outer end of each of said transverse partition panels, and a pair of transverse partition spacer straps foldably joined along the inner ends thereof to each of said second pair of medial panels respectively and foldably joined along the outer ends thereof to the adjacent one of said anchoring flaps respectively.

9. An article carrier blank according to claim 8 wherein said anchoring flaps are of generally T-shaped configuration.

10. An article carrier blank according to claim 8 wherein a hand gripping aperture is formed in each of said first and second medial panels and in said first and second outer handle panels.

* * * * *